US005423426A

United States Patent [19]

Harper

[11] Patent Number: 5,423,426

[45] Date of Patent: Jun. 13, 1995

[54] PORTABLE FOOD COOLER APPARATUS

[76] Inventor: Ella F. Harper, 698 Mini Dr., Vallejo, Calif. 94589

[21] Appl. No.: 238,701

[22] Filed: May 5, 1994

[51] Int. Cl.[6] ..... A45C 11/20; B65D 21/02; B65D 6/02

[52] U.S. Cl. ..... 206/545; 206/549; 206/503; 220/4.27; 220/23.83

[58] Field of Search ..... 206/541, 544, 545, 549, 206/503, 505, 515, 518, 519, 520; 220/4.27, 23.6, 23.83

[56] References Cited

U.S. PATENT DOCUMENTS

| | | | |
|---|---|---|---|
| 2,652,698 | 9/1953 | Schlumbohm | 206/545 X |
| 3,684,123 | 8/1972 | Bridges | 206/545 X |
| 3,811,559 | 5/1974 | Castes | 206/545 |
| 3,908,852 | 9/1975 | Ricobene et al. | 206/545 X |
| 4,091,953 | 5/1978 | Daenen | 220/23.6 X |
| 4,280,336 | 7/1981 | Taylor . | |
| 4,474,303 | 10/1984 | Maccise | 220/4.27 |
| 4,619,363 | 10/1986 | Wolfsedes | 220/4.27 X |
| 4,648,512 | 3/1987 | Tarozzi et al. . | |
| 4,662,188 | 5/1987 | Hullihan . | |
| 4,873,841 | 10/1989 | Bradshaw et al. . | |
| 4,955,957 | 9/1990 | Homes . | |
| 4,978,023 | 12/1990 | Behlmann et al. | 206/545 X |

*Primary Examiner*—Jacob K. Ackun

[57] ABSTRACT

A new and improved portable food cooler apparatus includes a base receptacle assembly which includes a top portion which is adapted to receive a top receptacle assembly. A top receptacle assembly includes a bottom portion adapted to be received by the top portion of the base receptacle assembly. The top receptacle assembly also includes a top portion adapted to receive a lid assembly. A lid assembly includes a bottom portion adapted to be received by the top portion of the top receptacle assembly. The base receptacle assembly includes a pair of first handle assemblies which are connected to opposite side walls of the base receptacle assembly. The top receptacle assembly includes a pair of second handle assemblies. The second handle assemblies are in the form of indentations in opposite side walls of the top receptacle assembly. The side walls of the base receptacle assembly, the side walls of the top receptacle assembly, and the side walls of the lid assembly are coplanar when the base receptacle assembly, the top receptacle assembly, and the lid assembly are connected together. The base receptacle assembly includes a drain plug assembly.

6 Claims, 2 Drawing Sheets

10
22
29
24
20
27
16
26
18
14
28
12
33
29
27
26
28
35
33

29
22
26
30
27
16
32
12
28

PORTABLE FOOD COOLER APPARATUS

BACKGROUND OF THE INVENTION

1. Field of the Invention

The present invention relates generally to food coolers and, more particularly, to portable food coolers.

2. Description of the Prior Art

Portable food coolers are well known in the art. Generally, the portable food coolers receive a quantity of ice or other coolant for cooling items placed in the coolers. The items that are cooled must generally be either packaged in water-tight containers, such as beverage cans and bottles, or :must be placed in water-tight containers. This is so because the ice melts, and the water from the melted ice can contaminate the items unless suitably protected.

There are numerous food items, however, that may not be conveniently placed in water-tight containers. For example, before certain food items are to be placed on a barbecue, it may be desirable to have the food marinated, seasoned, or sauted. It may be desirable to have the food remain in this pre-cooked condition for a predetermined period of time. In this respect, it would be desirable if a portable food cooler had provisions for retaining food that is not in water-tight containers for a predetermined period of time without the food getting wet from melted ice.

As food is waiting to be barbecued, often the food is open to the air and is subject to attack from flying insects. In this respect, it would be desirable if a portable food cooler were provided which protected food from flying insects prior to the food being barbecued.

When people have a barbecue outside their house, often the people will keep the food inside the house just prior to the barbecue. If this is done, to carry out the barbecue, a number of back and forth trips must be made between outside the house and inside the house. In this respect, it would be desirable if a portable food cooler were provided which precluded the necessity of making a number of trips from inside the house to outside the house for carrying food from inside the house that has been standing a predetermined period of time in a precooked status such as in a marinade.

If food is taken outside a house to sit for a predetermined period of time prior to its being barbecued, the food may be covered to prevent the food's being attacked by flying insects. Yet, when the food is covered, the food is not protected from ambient heat. The ambient temperature of a hot summer day may be deleterious to the food and may promote food spoilage. In this respect, it would be desirable if a food storage device were provided which protected the food from hot ambient air as the food is waiting to be barbecued.

Another set of circumstances that may prove to be a problem when food is placed outdoors for a period of time prior to a barbecue is the presence of direct sunlight. Direct sunlight may cause accelerated heating of food that should otherwise be kept at a cool temperature. In this respect, it would be desirable if a food storage device were provided that protects food from direct sunlight when the food a waiting to be barbecued.

Throughout the years, a number of innovations have been developed relating to portable food coolers, and the following U.S. patents are representative of some of those innovations: U.S. Pat. Nos. 4,280,336; 4,648,512; 4,662,188; 4,873,841; and 4,955,957.

More specifically, U.S. Pat. No. 4,280,336 disclose a portable cooler that has a food receptacle and a plurality of cylindrical receptacles for receiving cylindrical beverage cans. A cold pack is used for cooling. With this device, if a cold pack were not employed and ice cubes were used instead, then any food that were placed in the food receptacle would be subjected to being soaked by water from melted ice. In this respect, it would be desirable if a portable food cooler were provided that can employ either a cold pack or ice cubes for cooling food without subjecting the food from soaking from water from melted ice.

U.S. Pat. No. 4,648,512 discloses a portable cooler that has side receptacles for storing non-food items. Moreover, a common lid is placed over both a portion of the cooler that receives ice and a portion of the cooler that receives food items. If the food-receiving portion is removed from the cooler, the food-receiving portion is not covered and is subject to attack by insects and the direct rays of the sun. In this respect, it would be desirable if a portable food cooler were provided which included a food-receiving portion that has its own lid that stays with the food-receiving portion when the food-receiving portion is removed from the ice-receiving portion.

U.S. Pat. No. 4,662,188 discloses a portable cooler or ice chest in which items are stored in one plane and are reoriented 90 degrees when carried in brief-case-like fashion. As a result, stored items may be overturned and upset when stored and then carried. In this respect, it would be desirable if a portable food cooler were provided which does not reorient stored items when the cooler is carried.

U.S. Pat. No. 4,873,841 discloses a wheeled carrier for a portable cooler. U.S. Pat. No. 4,955,957 discloses a portable cooler which includes means for securing the cooler to a carrier surface. Although special carriers may be desirable for certain coolers, especially large coolers that are difficult to carry, it is preferable if a portable cooler were sufficiently small and light-weight as to be readily transported by carrying the cooler with handles connected to the cooler.

Thus, while the foregoing body of prior art indicates it to be well known to use portable food coolers, the prior art described above does not teach or suggest a portable food cooler apparatus which has the following combination of desirable features: (1) has provisions for retaining food that is not in water-tight containers for a predetermined period of time without the food getting wet from melted ice; (2) protects food from flying insects prior to the food being barbecued; (3) precludes the necessity of making a number of trips from inside the house to outside the house for carrying food from inside the house that has been standing a predetermined period of time in a precooked status; (4) protects the food from hot ambient air as the food is waiting to be barbecued; (5) protects food from direct sunlight when the food is waiting to be barbecued; (6) can employ either a cold pack or ice cubes for cooling food without subjecting the food to a soaking from water from melted ice; (7) includes a food-receiving portion that has its own lid that stays with the food-receiving portion when the food-receiving portion is removed from the ice-receiving portion; (8) does not reorient stored items when the cooler is carried; and (9) is sufficiently small and light-weight as to be readily transported by carrying the cooler with handles connected to the cooler. The foregoing desired characteristics are provided by the unique portable food cooler apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved portable food cooler apparatus which includes a base receptacle assembly which includes a top portion which is adapted to receive a top receptacle assembly. A top receptacle assembly includes a bottom portion adapted to be received by the top portion of the base receptacle assembly. The top receptacle assembly also includes a top portion adapted to receive a lid assembly. A lid assembly includes a bottom portion adapted to be received by the top portion of the top receptacle assembly.

The base receptacle assembly includes a pair of first handle assemblies which are connected to opposite side walls of the base receptacle assembly. The top receptacle assembly includes a pair of second handle assemblies. The second handle assemblies are in the form of indentations in opposite side wails of the top receptacle assembly.

The top portion of the base receptacle assembly is in the form of a planar rim. The bottom portion of the top receptacle assembly is in the form of an L-shaped flange which includes a planar horizontal portion capable of fitting onto the planar rim of the base receptacle assembly, and which includes a planar vertical portion capable of fitting into the base receptacle assembly. The top portion of the top receptacle assembly includes a planar rim, and the bottom portion of the lid assembly is in the form of an L-shaped flange which includes a planar horizontal portion capable of fitting onto the planar rim of the top receptacle assembly, and which includes a planar vertical portion capable of fitting into the top receptacle assembly.

The side walls of the base receptacle assembly, the planar rim of the base receptacle assembly, the L-shaped flange of the top receptacle assembly, the side walls of the top receptacle assembly, the planar rim of the top receptacle assembly, and the L-shaped flange of the lid assembly are dimensioned such that the side walls of the base receptacle assembly, the side walls of the top receptacle assembly, and side walls of the lid assembly are coplanar when the base receptacle assembly, the top receptacle assembly, and the lid assembly are connected together. The base receptacle assembly includes a drain plug assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved portable food cooler apparatus which has all of the advantages of the prior art and none of the disadvantages.

It is another object of the present invention to provide a new and improved portable food cooler apparatus which may be easily and efficiently manufactured and marketed.

It is a further object of the present invention to provide a new and improved portable food cooler apparatus which is of durable and reliable construction.

An even further object of the present invention is to provide a new and improved portable food cooler apparatus which is susceptible of a low cost of manufacture with regard to both materials and labor, and which accordingly is then susceptible of low prices of sale to the consuming public, thereby making such portable food cooler apparatus available to the buying public.

Still yet a further object of the present invention is to provide a new improved portable food cooler apparatus which has provisions for retaining food that is not in water-tight containers for a predetermined period of time without the food getting wet from melted ice.

Still another object of the present invention is to provide a new and improved portable food cooler apparatus that protects food from flying insects prior to the food being barbecued.

Yet another object of the present invention is to provide a new and improved portable food cooler apparatus which precludes the necessity of making a number of trips from inside the house to outside the house for carrying food from inside the house that has been standing a predetermined period of time in a precooked status.

Even another object of the present invention is to provide a new and improved portable food cooler apparatus that protects the food from hot ambient air as the food is waiting to be barbecued.

Still a further object of the present invention is to provide a new and improved portable food cooler apparatus which protects food from direct sunlight when the food is waiting to be barbecued.

Yet another object of the present invention is to provide a new and improved portable food cooler apparatus that can employ either a cold pack or ice cubes for cooling food without subjecting the food to a soaking from water from melted ice.

Still another object of the present invention is to provide a new and improved portable food cooler apparatus which includes a food-receiving portion that has its own lid that stays with the food-receiving portion when the food-receiving portion is removed from the ice-receiving portion.

Yet another object of the present invention is to provide a new and improved portable food cooler apparatus that does not reorient stored items when the cooler is carried.

Still a further object of the present invention is to provide a new and improved portable food cooler apparatus that is sufficiently small and light-weight as to be readily transported by carrying the cooler with handles connected to the cooler.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved portable food cooler apparatus embodying the principles and concepts of the present invention will be described.

Figure 1:
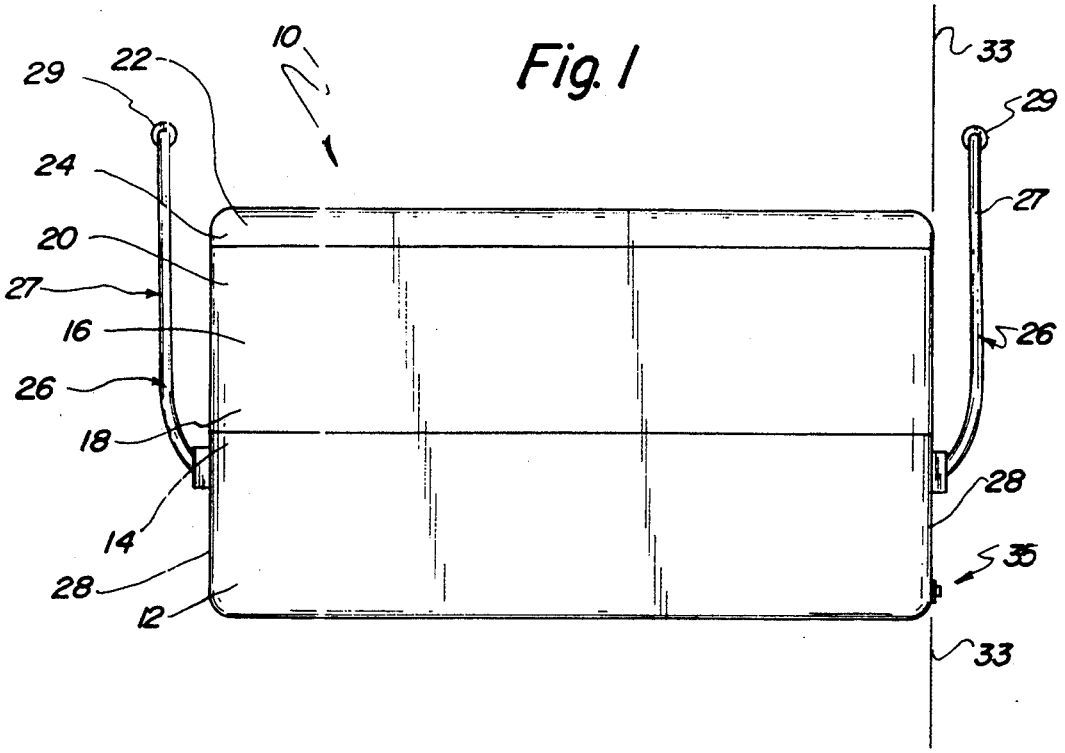
FIG. 1 is a front view showing a first preferred embodiment of the portable food cooler apparatus of the invention.
Figure 2:
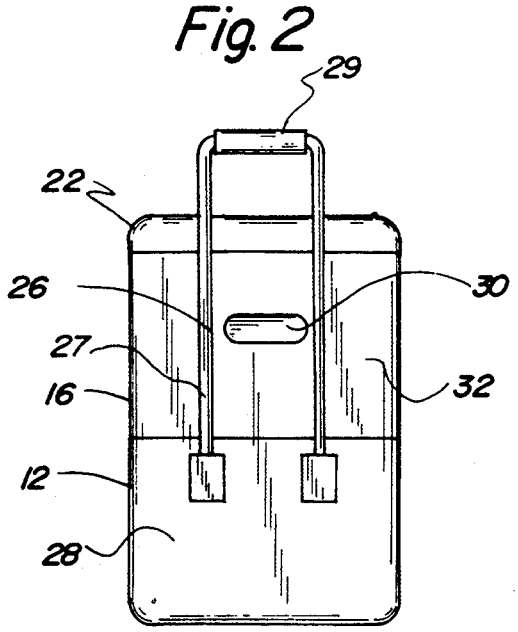
FIG. 2 is a side view of the embodiment of the portable food cooler apparatus of FIG. 1.
Figure 3:
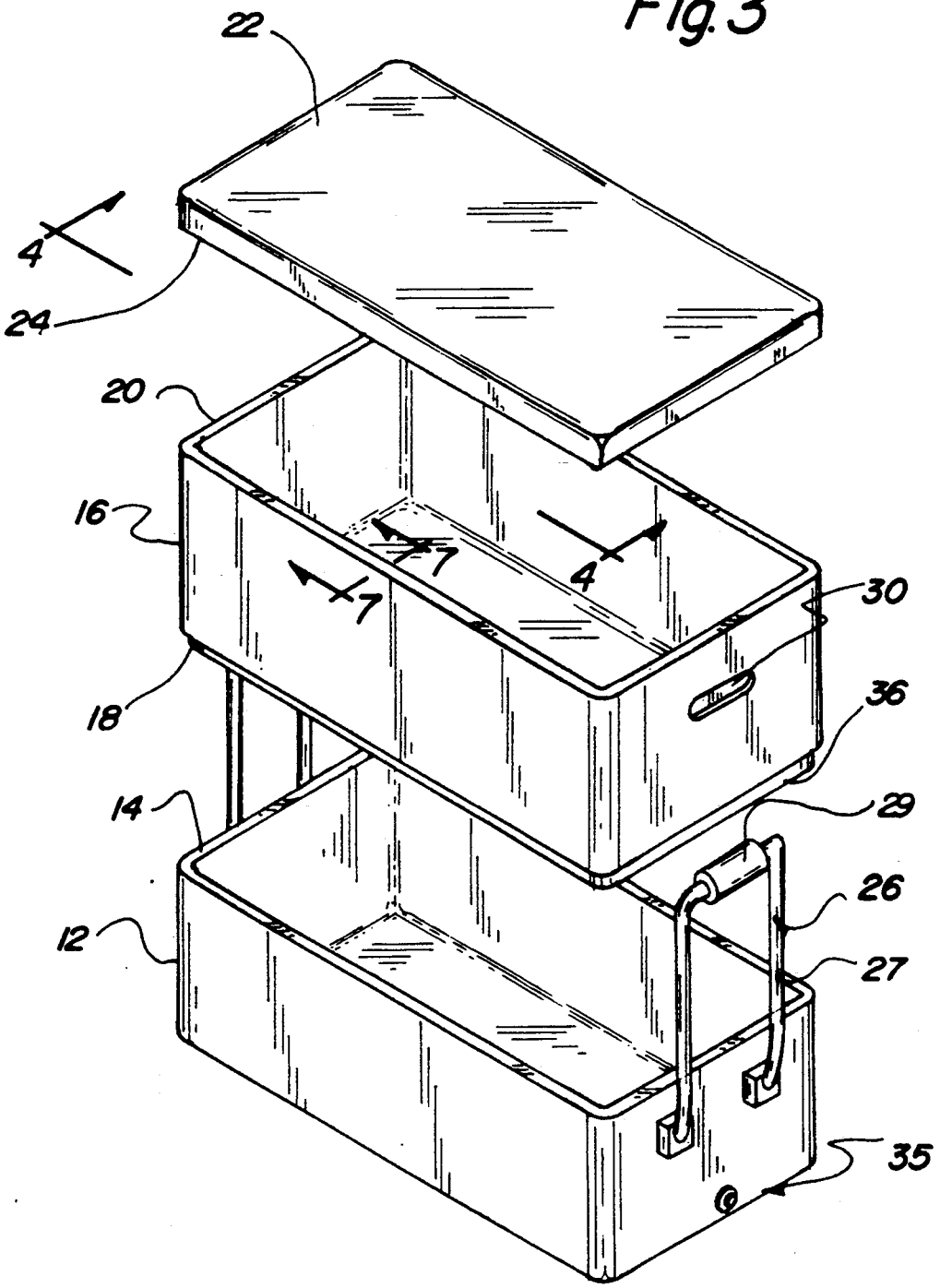
FIG. 3 is an exploded perspective view of the portable food cooler apparatus of FIG. 1.
Figure 4:
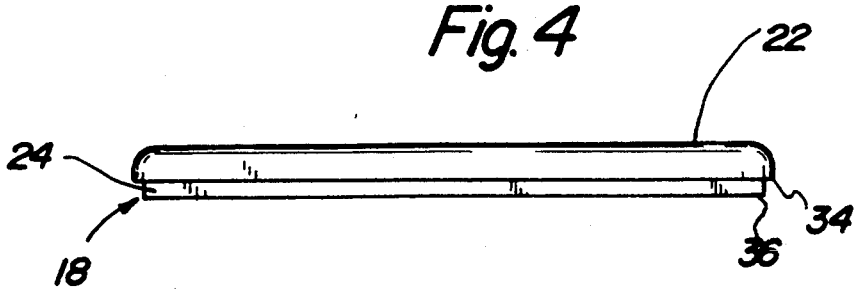
FIG. 4 is a front view of the lid of the embodiment of the invention shown in FIG. 3.

Turning initially to FIGS. 1–4, there is shown a first exemplary embodiment of the portable food cooler apparatus of the invention generally designated by reference numeral 10. In its preferred form, portable food cooler apparatus 10 includes a base receptacle assembly 12 which includes a top portion 14 which is adapted to receive a top receptacle assembly 16. A top receptacle assembly 16 includes a bottom portion 18 adapted to be received by the top portion 14 of the base receptacle assembly 12. The top receptacle assembly 16 also includes a top portion 20 adapted to receive a lid assembly 22. A lid assembly 22 includes a bottom portion 24 adapted to be received by the top portion 20 of the top receptacle assembly 16.

The base receptacle assembly 12 includes a pair of first handle assemblies 26 which are connected to opposite side wails 28 of the base receptacle assembly 12. The top receptacle assembly 16 includes a pair of second handle assemblies 30. The second handle assemblies 30 are in the form of indentations 30 in opposite side walls 32 of the top receptacle assembly 16.

The top portion 14 of the base receptacle assembly 12 is in the form of a planar rim 14. The bottom portion 18 of the top receptacle assembly 16 is in the form of an L-shaped flange 18 which includes a planar horizontal portion 34 capable of fitting onto the planar rim 14 of the base receptacle assembly 12, and which includes a planar vertical portion 36 capable of fitting into the base receptacle assembly 12. The top portion 20 of the top receptacle assembly 16 includes a planar rim 20, and the bottom portion 24 of the lid assembly 22 is in the form of an L-shaped flange 18 which includes a planar horizontal portion 34 capable of fitting onto the planar rim 20 of the top receptacle assembly 16, and which includes a planar vertical portion 36 capable of fitting into the top receptacle assembly 16.

The side walls 28 of the base receptacle assembly 12, the planar rim 14 of the base receptacle assembly 12, the L-shaped flange 18 of the top receptacle assembly 16, the side walls 32 of the top receptacle assembly 16, the planar rim 20 of the top receptacle assembly 16, and the L-shaped flange 18 of the lid assembly 22 are dimensioned such that the side walls 28 of the base receptacle assembly 12, the side walls 32 of the top receptacle assembly 16, and side walls of the lid assembly 22 are coplanar along plane 33 when the base receptacle assembly 12, the top receptacle assembly 16, and the lid assembly 22 are connected together.

The base receptacle assembly 12 includes a drain plug assembly 35. When some of the ice in the base receptacle assembly 12 melts, it may be desirable to drain the water out of the base receptacle assembly 12. The water can be readily drained from the base receptacle assembly 12 through the drain plug assembly 35.

In use, the apparatus 10 of the invention is first disassembled. Then, ice cubes or a cold pack are placed into the base receptacle assembly 12. The top receptacle assembly 16 is placed upon the base receptacle assembly 12, such that the L-shaped flange 18 on the bottom of the top receptacle assembly 16 engages the planar rim 14 of the base receptacle assembly 12. Food is then placed inside the top receptacle assembly 16. The food need not be placed in water-tight containers because the top receptacle assembly 16 is itself a water-tight container with respect to any water formed from melted ice that is present in the base receptacle assembly 12. The lid assembly 22 is then placed on the top receptacle assembly 16 with the L-shaped flange 18 on the bottom of the lid assembly 22 engaging the planar rim 20 on the top of the top receptacle assembly 16. This combination of base receptacle assembly 12, ice cubes, top receptacle assembly 16, food, and lid assembly 22 can be carried by the use of first handle assemblies 26.

When food is to be used, the combination of the top receptacle assembly 16 and the lid assembly 22 can be lifted off of the base receptacle assembly 12 by the second handle assemblies 30. This combination can be carried to another location, such as a barbecue, with the lid assembly 22 in place on the top receptacle assembly 16 serving to protect the food therein from insects and direct sunlight.

When the barbecuing is finished, the combination of top receptacle assembly 16 and lid assembly 22 can be returned to the base receptacle assembly 12, and the entire apparatus can be transported by the first handle assemblies 26. As shown in the figures, the first handle assemblies 26 include vertically extending portions 27 which are sufficiently long to extend from the side walls 28 of the base receptacle assembly 12 to above the level of the lid assembly 22 so that horizontal portions 29 of the first handle assemblies 26 are above the level of the lid assembly 22. This combination of base receptacle assembly 12, ice cubes, top receptacle assembly 16, food, and lid assembly 22 can be carried by grasping the horizontal portions 29 of the first handle assemblies 26.

It will be appreciated that the walls of the respective base receptacle assembly 12 and the respective top receptacle assembly 16 can includes insulation. More specifically, and to illustrate without limiting the invention, the insulation can includes a plurality of gel bubbles distributed throughout an insulation matrix which may includes glass wool or other insulative materials.

The portable food cooler apparatus 10 of the invention can be made in a variety of sizes which may be contemplated as small, medium, and large. The apparatus can also be provided in a variety of colors. The preferred material of construction is durable plastic materials such as used with conventional portable food coolers. Moreover, the walls of the base receptacle assembly 12, the top receptacle assembly 16, and the lid assembly 22 can be insulated in conventional ways, such as used with conventional portable food coolers. The portable food cooler apparatus 10 of the invention can be used for a variety of purposes, and it is especially useful for storing and carrying foods that are to be barbecued. In addition, the portable food cooler apparatus 10 of the invention can be used in a variety of other milieus such as a picnic, camping, an outing to a park, a baseball or football game, or a tailgate party, and so on.

The following list of foods is not by any all-inclusive but is representative of some of the foods that can suitably be stored and carried by the portable food cooler apparatus 10 of the invention sushi, cold cuts, fresh vegetables, fresh fruits, hamburger meat, steak, chicken, links, shish-ka-bobs, wieners, and fish.

If desired, beverages or other foods in water-tight containers can be carried in the base receptacle assembly 12, and other foods can be carried in the top receptacle assembly 16.

The components of the portable food cooler apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved portable food cooler apparatus that is low in cost, relatively simple in design and operation, and which may advantageously be used to retain food that is not in water-tight containers for a predetermined period of time without the food getting wet from melted ice. With the invention, a portable food cooler apparatus is provided which protects food from flying insects prior to the food being barbecued. With the invention, a portable food cooler apparatus is provided which precludes the necessity of making a number of trips from inside the house to outside the house for carrying food from inside the house that has been standing a predetermined period of time in a precooked status. With the invention, a portable food cooler apparatus is provided which protects the food from hot ambient air as the food is waiting to be barbecued. With the invention, a portable food cooler apparatus is provided which protects food from direct sunlight when the food is waiting to be barbecued. With the invention, a portable food cooler apparatus is provided which can employ either a cold pack or ice cubes for cooling food without subjecting the food to a soaking from water from melted ice. With the invention, a portable food cooler apparatus is provided which includes a food-receiving portion that has its own lid that stays with the food-receiving portion when the food-receiving portion is removed from the ice-receiving portion. With the invention, a portable food cooler apparatus is provided which does not reorient stored items when the cooler is carried. With the invention, a portable food cooler apparatus is provided which is sufficiently small and light-weight as to be readily transported by carrying the cooler with handles connected to the cooler.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A new and improved portable food cooler apparatus, comprising:

a base receptacle assembly which includes a top portion which is adapted to receive a top receptacle assembly, a top receptacle assembly which includes a bottom portion adapted to be received by said top portion of said base receptacle assembly, said top receptacle assembly also including a top portion adapted to receive a lid assembly, a lid assembly which includes a bottom portion adapted to be received by said top portion of said top receptacle assembly, and a pair of first handle assemblies connected to opposite side walls of said base receptacle assembly wherein said first handle assemblies include vertically extending portions which are connected to said side walls of said base receptacle and which are sufficiently long to extend from said side walls of said base receptacle assembly to above said lid assembly such that horizontal portions of said first handle assemblies are above said lid assembly.

2. The apparatus described in claim 1 wherein said top receptacle assembly includes a pair of second handle assemblies.

3. The apparatus described in claim 2 wherein said second handle assemblies are in the form of indentations in opposite side walls of said top receptacle assembly.

4. The apparatus described in claim 1 wherein:

said top portion of said base receptacle assembly is in the form of a planar rim, said bottom portion of said top receptacle assembly is in the form of an L-shaped flange which includes a planar horizontal portion capable of fitting onto said planar rim of said base-receptacle assembly, and which includes a planar vertical portion capable of fitting into said base receptacle assembly, said top portion of said top receptacle assembly includes a planar rim, and said bottom portion of said lid assembly is in the form of an L-shaped flange which includes a planar horizontal portion capable of fitting onto said planar rim of said top receptacle assembly, and which includes a planar vertical portion capable of fitting into said top receptacle assembly.

5. The apparatus described in claim 4 wherein said side walls of said base receptacle assembly, said planar rim of said base receptacle assembly, said L-shaped flange of said top receptacle assembly, said side walls of said top receptacle assembly, said planar rim of said top receptacle assembly, and said L-shaped flange of said lid assembly are dimensioned such that said side walls of said base receptacle assembly, said side walls of said top receptacle assembly, and side walls of said lid assembly are coplanar when said base receptacle assembly, said top receptacle assembly, and said lid assembly are connected together.

6. The apparatus described in claim 1 wherein said base receptacle assembly includes a drain plug assembly.

* * * * *